United States Patent [19]

Greco et al.

[11] 4,455,507

[45] Jun. 19, 1984

[54] DOUBLE WEDGE TERMINATION DEVICE FOR COUPLED CAVITY TRAVELING WAVE TUBES

[75] Inventors: Norman A. Greco, Torrance; Simon Z. Arkoff, Rancho Palos Verdes, both of Calif.

[73] Assignee: Hughes Aircraft Company, El Segundo, Calif.

[21] Appl. No.: 364,947

[22] Filed: Apr. 2, 1982

[51] Int. Cl.[3] ..... H01J 25/34

[52] U.S. Cl. ..... 315/3.5; 315/3.6; 315/39.3; 333/81 R

[58] Field of Search ..... 315/3.5, 3.6, 39.3; 333/81 R

[56] References Cited

U.S. PATENT DOCUMENTS

| | | | |
|---|---|---|---|
| 3,123,736 | 3/1964 | Christoffers et al. | 315/3.6 |
| 3,181,023 | 4/1965 | Hant et al. | 315/3.5 |
| 4,019,087 | 4/1977 | Hamada et al. | 315/3.5 |
| 4,105,911 | 8/1978 | King et al. | 315/3.5 |
| 4,147,956 | 4/1979 | Horigome et al. | 315/3.5 |
| 4,258,286 | 3/1981 | Kageyama | 315/3.5 |

*Primary Examiner*—Saxfield Chatmon, Jr.

*Attorney, Agent, or Firm*—Paul M. Coble; A. W. Karambelas; Charles D. Brown

[57] ABSTRACT

A termination device for absorbing RF energy waves in the termination chamber of a traveling wave tube. The termination device is formed by modifying two wedge shaped termination devices of the prior art. Specifically, two well known single wedge termination devices are sliced in half to produce two wedges each one half the thickness of the prior art single wedge device. The two halves are positioned with their newly formed surface, formed by the slicing, in opposed facing contact. The new double wedge thus has the same thickness as the prior single wedge and is readily accommodated within the termination chamber. The double wedge termination device greatly reduces small signal gain variations across the operating frequency band of the traveling wave tube.

6 Claims, 11 Drawing Figures

DOUBLE WEDGE TERMINATION DEVICE FOR COUPLED CAVITY TRAVELING WAVE TUBES

BACKGROUND OF THE INVENTION

1. Field of the Invention

This invention relates to electromagnetic circuit technology and more particularly to the design of termination devices used in coupled cavity traveling wave tubes (TWTs).

2. Prior Art

Prior art termination devices include the common wedge device. The device may be comprised of a lossy ceramic and positioned within the termination chamber such that the thick portion of the wedge is located at the radially outer portion of the chamber and the edge of the wedge is proximate the central aperture of the chamber. The exterior dimensions of the wedge are chosen such that the wedge conforms to the interior dimensions of the termination chamber. A single such wedge placed inside the termination chamber serves to provide a termination match for the traveling wave tube. A typical TWT termination chamber provided with such a termination device will, nonetheless, exhibit a certain amount of small signal gain variation, phase ripple and amplitude modulation to phase modulation conversion. It is obviously desirable to minimize all such distortions occurring in the termination chamber. Accordingly, it is an object of the present invention to provide a TWT termination device that significantly reduces such distortions and improves the performance of the TWT and its termination assembly as a whole.

Some relevant patents, which may serve to illustrate the evolution of termination device design, include U.S. Pat. Nos. 2,985,792, 3,123,736 and 3,181,023. These patents show internal termination (i.e., internal to the chamber), external termination, and hybrid termination, respectively. The latter patent also shows use of a single wedge termination the specific shape of which is set forth at Column 6, lines 3–39. A copy of U.S. Pat. No. 3,181,023 is enclosed.

SUMMARY OF THE INVENTION

The invention comprises a double wedge termination device formed by assembling two modified single wedge devices of the prior art, both of which have been sliced in half so that they are one-half their former thickness. The two sliced wedges are positioned with their sliced surfaces in opposed facing contact. Since each single wedge is sliced in half, the new double wedge has the same thickness as the prior single wedge and is readily accommodated within the termination chamber. The sloping surfaces of the wedges are positioned so that the surfaces slope toward one another with increasing radial distances.

DETAILED DESCRIPTION OF THE INVENTION

Figure 1:
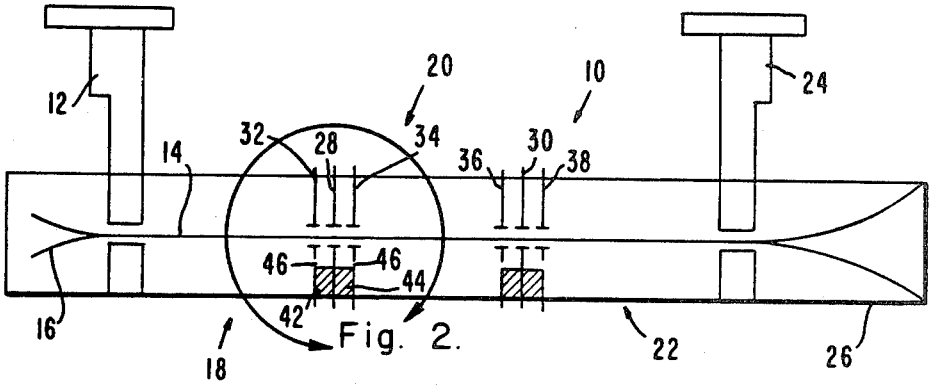
FIG. 1 is a functional representation of a three section traveling wave tube circuit.

The present invention is an RF termination device designed to minimize reflections in the various circuit sections of traveling wave tubes (TWTs). A simplified representation of a three-section TWT circuit is shown in FIG. 1. Such multiple section coupled cavity TWTs are necessary to effect high gain in the RF circuit. Electromagnetic waves are coupled to the TWT 10 through the RF input coupler 12 and modulate the electron beam 14, produced by the gun 16, within the first RF circuit section 18. The electromagnetic waves and the electron beam 14 travel axially through the three RF circuit sections 18, 20 and 22 from left to right as seen in FIG. 1. At the right hand end of section 22 the electromagnetic waves exit through RF output coupler 24 and the electron beam 14 passes into collector 26. Each of the RF sections 18, 20 and 22 is separated from the adjacent section by a solid metal wall called a sever. Severs 28 and 30 prevent circuit RF waves from passing from one section to the next. RF coupling between sections is by means of the modulated electron beam 14 which travels along the axis of the TWT.

The small chambers 32, 34, 36 and 38, located between sections 18 and 20 and sections 20 and 22, are called terminations. In addition to providing RF isolation between circuit sections, the terminations must also provide a high return loss for any incident RF waves. This is a necessary condition to achieve the design objectives of low small signal gain variation, frequency stability and small phase ripple.

Any RF wave energy remaining after the RF wave has traveled to the right hand end of section 18, enters termination chamber 32 through slot 46 and is dissipated by the termination ceramic 48. If wave reflections occur, they will travel back through section 18 to the RF input coupler 12, and be reflected again, causing gain and phase ripple. A perfect RF termination (i.e., dissipation of 100% of the incident RF waves) will produce no gain or phase ripple.

Section 20 operates in substantially the same manner. However, section 20 has two RF terminations 34 and 36, one (36) for dissipating the forward traveling waves and one (34) for dissipating any backward traveling waves. Forward as used herein means in the same direction in which the electron beam travels, i.e., left to right in FIG. 1.

Figure 2:
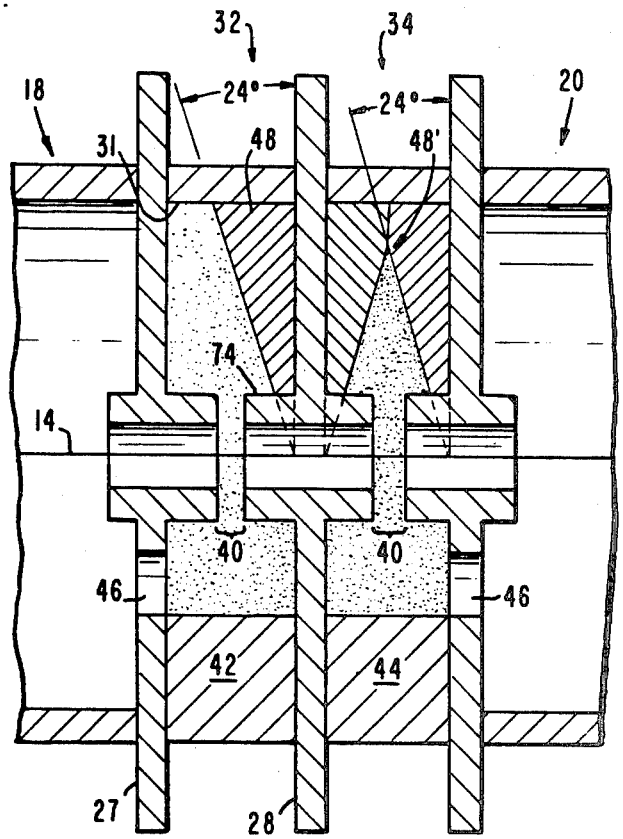
FIG. 2 is an enlarged view of a section taken along the line 2—2 of FIG. 1 and illustrating the placement of the sloping wedge surface within the termination chamber.

In section 22, the RF wave traveling forward passes through the RF output coupler 24 and to the antenna or other system load (not shown). It is impossible to build a perfect coupler (i.e., coupler 24) and hence there are always some wave reflections which will travel backward through section 22 toward termination chamber 38. Ideal TWT design would call for a termination chamber 38 which absorbs or dissipates 100% of the incident wave energy (i.e., zero reflection) in order to minimize gain and phase ripple. The percentage of dissipation is determined by the design of the termination chambers. A pair of termination chambers 32 and 34, separated by sever 28 is illustrated in FIG. 2.

Various portions of the structure of the termination chambers can be altered to affect the dissipation percentage, including the chamber gap 40, the position of the back walls 42 and 44, the coupling slot 46 and the termination device (which may be a ceramic) 48. It is, of course, presumed that the external dimensions and circuit period of the TWT are not to be changed. The present invention is concerned exclusively with the change in dissipation percentage resulting from a change in configuration of the termination ceramic 48. The goal is to approach as nearly as possible 100% dissipation.

Figure 3:
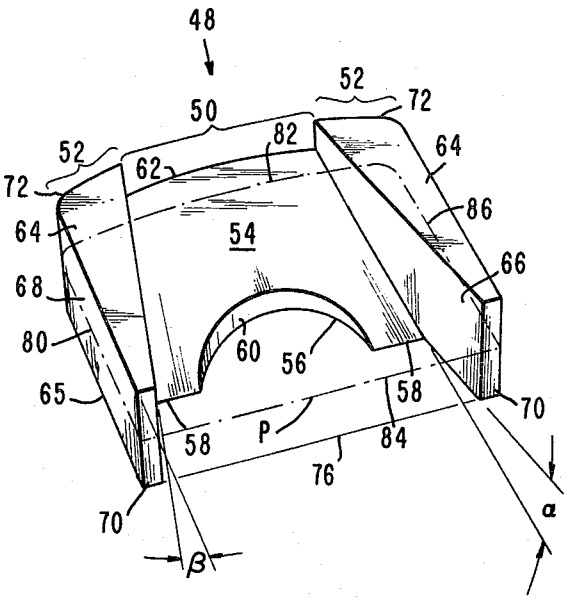
Fig. 3. (PRIOR ART)
FIG. 3 is a perspective view of a prior art termination wedge.

The termination ceramic 48 shown in chamber 32 represents the prior art configuration shown in perspective in FIG. 3. The termination ceramic 48' shown in the chamber 34 represents the double wedge configuration of the present invention shown in perspective in FIGS. 5 and 6.

With reference now to FIG. 3, the structural details of the single wedge termination ceramic 48 are readily apparent. The termination ceramic may be any suitable lossy ceramic, and particularly may be beryllium oxide impregnated with a percentage of silicon carbide (e.g. 40 percent). The ceramic 48 has a central wedge shaped portion 50 and two tapered sidewall portions 52, one on each side thereof. Wedge portion 50 has a top surface 54 sloping at an angle $\alpha$ with respect to bottom surface 56 (visible in FIG. 6) to define the wedge edge 58. Wedge portion 50 also has a semicircular cutout defined by the semicircular surface 60, in edge 58, and has a third surface 62. Each tapered sidewall portion 52 has a top surface 64 parallel to its bottom surface 65, and an inner wall surface 66 positioned at an angle $\beta$ with respect to outer wall surface 68. Bottom surface 56 of the wedge portion 50 is coplanar with the bottom surface 65 of each sidewall portion 52. Each sidewall portion 52 also has a narrow front surface 70 and a wider back surface 72. The back surfaces 72 form a smooth curvilinear surface with surface 62 of the central wedge portion 50.

Figure 4:
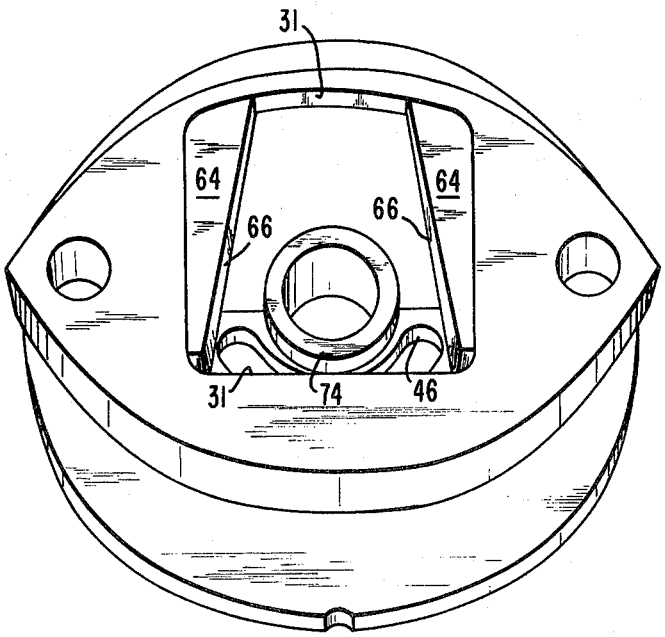
Fig. 4. (PRIOR ART)
FIG. 4 is a perspective view of an open termination chamber showing a prior art termination wedge positioned therein.

The termination ceramic 48 is held in position within the termination chamber 32 by a close fit arrangement between the walls 31 of the chamber and the walls of the termination ceramic and specifically by engagement of surfaces 72 and 62 with the inner wall 31 of chamber 32, and engagement of semicircular surface 60 with the exterior surface of ferrule 74 as shown in FIG. 4. Each termination chamber is defined by a pair of radially extending walls axially spaced apart from one another, such as wall 27 and sever 28, and the interior circumferential chamber wall 31.

While the present invention is not limited to a termination ceramic 48' of any specific dimensions, an appreciation of the scale of the various figures may be obtained by noting the specific dimensions of the particular termination ceramic of FIG. 3. The distance between outside walls 68 is 1.696 inches (4.308 cm.). The distance between top surface 64 and bottom surface 65 is 0.650 inch (1.651 cm.). The distance from a line 76, connecting the two surfaces 70, to the midpoint of the curvelinear surface 62 is 1.568 inches (3.983 cm.), with the radius of curvature of surface 62 being 1.995 inches (5.0673 cm.). Edge 58 is spaced 0.50 inch (1.27 cm) from line 76. The radius of curvature of surface 60 is 0.393 inch (0.998 cm.). $\beta$ is 11 degrees and $\alpha$ is 24 degrees. The dimensions for a particular application will depend on the dimensions of the TWT, the circuit period and other parameters known to skilled designers.

Figure 5:
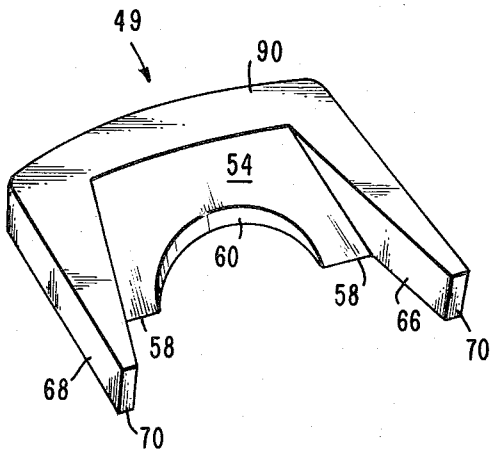
FIG. 5 is a perspective view of one half of the assembled termination double wedge of the invention.
Figure 6:
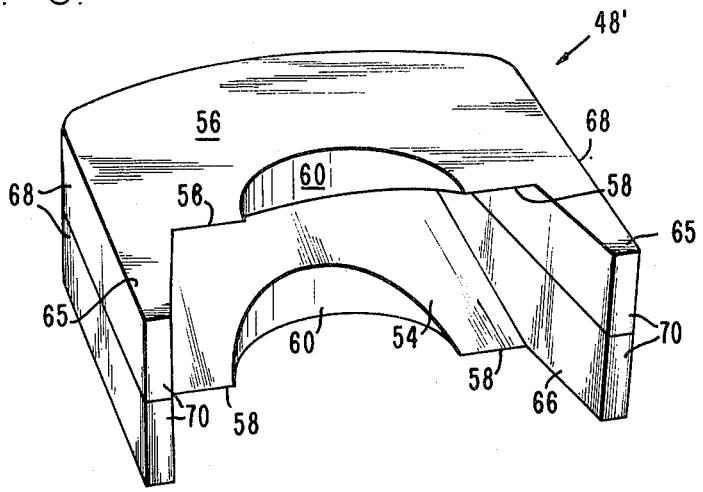
FIG. 6 is a perspective view of two halves positioned to form the double wedge termination device of the present invention.

The double wedge termination ceramic 48' is formed by joining two half portions 49 of a termination ceramic 48. The termination ceramic 48 is sliced in half through the plane P as defined by broken lines 80, 82, 84 and 86 in FIG. 3. The two half portions are not identical. The upper half portion as seen in FIG. 3 is removed and discarded. The retained half portion 49 is shown in FIG. 5. Two such retained half portions 49 are placed together with their newly formed surfaces 90 in contact with one another. Thus, as shown in FIG. 6, the two wedge portions 50 slope toward each other with increasing radial distance from the ferrule 74 of the termination chamber. The surfaces 54 and sidewalls 66 of the double wedge ceramic 48' generally define a cavity which itself is wedge shaped. Because each half portion is one-half the thickness of the original termination ceramic 48, the thickness of the termination ceramic 48' is identical to the thickness of ceramic 48. Termination ceramic 48' is thus easily substituted for ceramic 48 and readily placed in position within the termination chamber.

The double wedge termination ceramic 48' is characterized in that it has two wedge portions 50, two edges 58, and comprises substantially more ceramic material than is contained in a single wedge termination ceramic 48. Because the two wedges slope toward one another, the effective slope seen by the incident RF waves is twice the slope of the single wedge ceramic 48. Thus the RF waves are attenuated at twice the rate (48 degrees instead of 24 degrees).

As shown in FIG. 6, the exterior of the termination device is generally U-shaped. The major opposed surfaces such as surfaces 56, 56 and exterior wall surfaces 68, 68 are parallel to one another. The sidewall portions 52 form the arms of the U-shape and the surface 70 defines the free end of each arm. The arms of the U are joined together by the web-like wedge-shaped portions 50, thereby defining a cavity between the wedge-shaped portions 50 which is itself wedge-shaped and which is open in the direction of the free ends of the arms of the U.

It has been generally accepted by those skilled in the art that small signal gain variations in coupled cavity TWTs can be reduced by improving the RF matches, i.e., by designs which reduce the electromagnetic wave (RF) reflections in the coupled cavities. Improved RF matches also reduce phase ripple and other phase distortions such as amplitude modulation (AM) to phase modulation (PM) conversion. It is also generally accepted that best RF matches are obtained by a gradual attenuation of the incoming RF wave. Thus the thinnest part (edge 58) of the wedge is placed near the TWT termination chamber center (i.e., near ferrule 74), with the wedge gradually increasing in thickness to its maximum height near the radially outer chamber wall 31. Such a design also minimizes heating effects on the thin edge 58. Conventional design procedures also assume that a cold match is easier to achieve, and a better cold match can be obtained, with the use of less loss material (i.e., ceramic) in the termination chamber. This is accepted, since the impedance of a chamber having less ceramic inside it is less drastically changed from a standard circuit chamber.

The design changes described herein and made to achieve the double wedge termination ceramic 48' were made with the intended purpose of achieving an improved cold match. It was believed that the ultimate goal of reducing small signal gain variations would necessarily follow.

It was postulated that RF loss occurs in the lossy ceramic primarily due to electric field interactions. Since electric fields are strongest near the termination chamber center (i.e., near ferrule 74) it was thought that an increase in the amount of ceramic material at the chamber center should increase RF loss and thereby improve the cold match absorbtion. An easy way to increase the amount of ceramic material near the ferrule 74 would be to use a double wedge, which was readily constructed by modification of the well known single wedge as described above. It was recognized that use of such a double wedge ceramic would effectively introduce ceramic into the incident RF energy waves at twice the rate as a single wedge (i.e., 48 degrees versus 24 degrees). As a result, a slight degradation in cold match test characteristics was expected. An adjustment in the angle $\alpha$ was expected to compensate for the slight degradation.

Cold match tests were conducted on the input side and output side of a two section TWT to substantiate the expected results. The two section TWT was much like the three section TWT 10 shown in FIG. 1 except it had no center section 20 and no termination chambers 34 and 36. Chamber 38 abutted chamber 32 just as chamber 34 abuts chamber 32 in FIG. 1. An output cold test was conducted with only low voltage levels and no electron beam 14 present in the TWT. An RF energy wave was introduced into output section 22 via RF output coupler 24. The energy wave traveled the length of section 22 and entered termination chamber 38 and encountered the termination ceramic (48 or 48'). A portion of the RF energy was reflected back through section 22 and out the output coupler 24. The magnitude of the reflected wave compared to the magnitude of the incident wave gives the percentage of reflection by the termination chamber.

Figure 7:
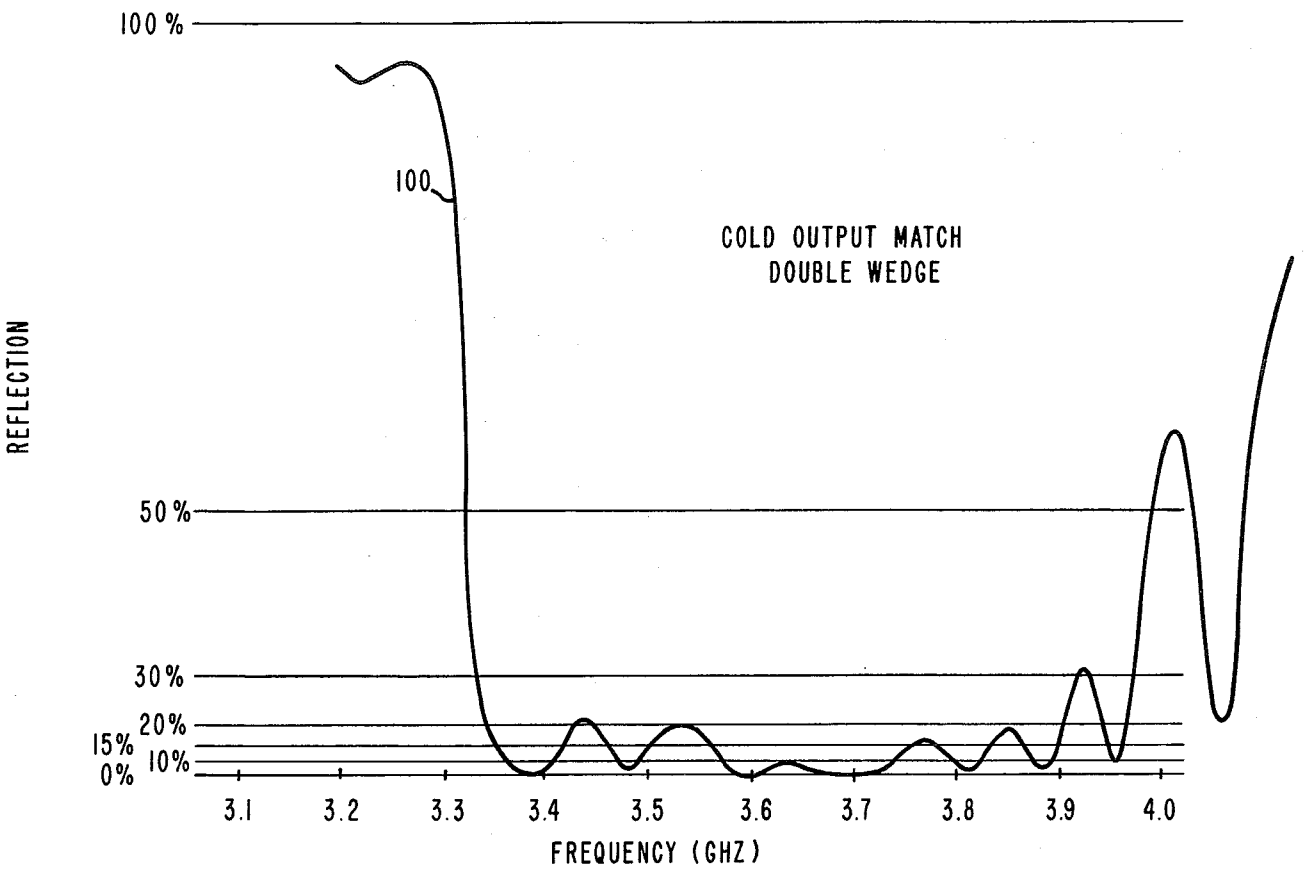
FIG. 7 is a graph of the output cold match test results for the double wedge termination device.
Figure 8:
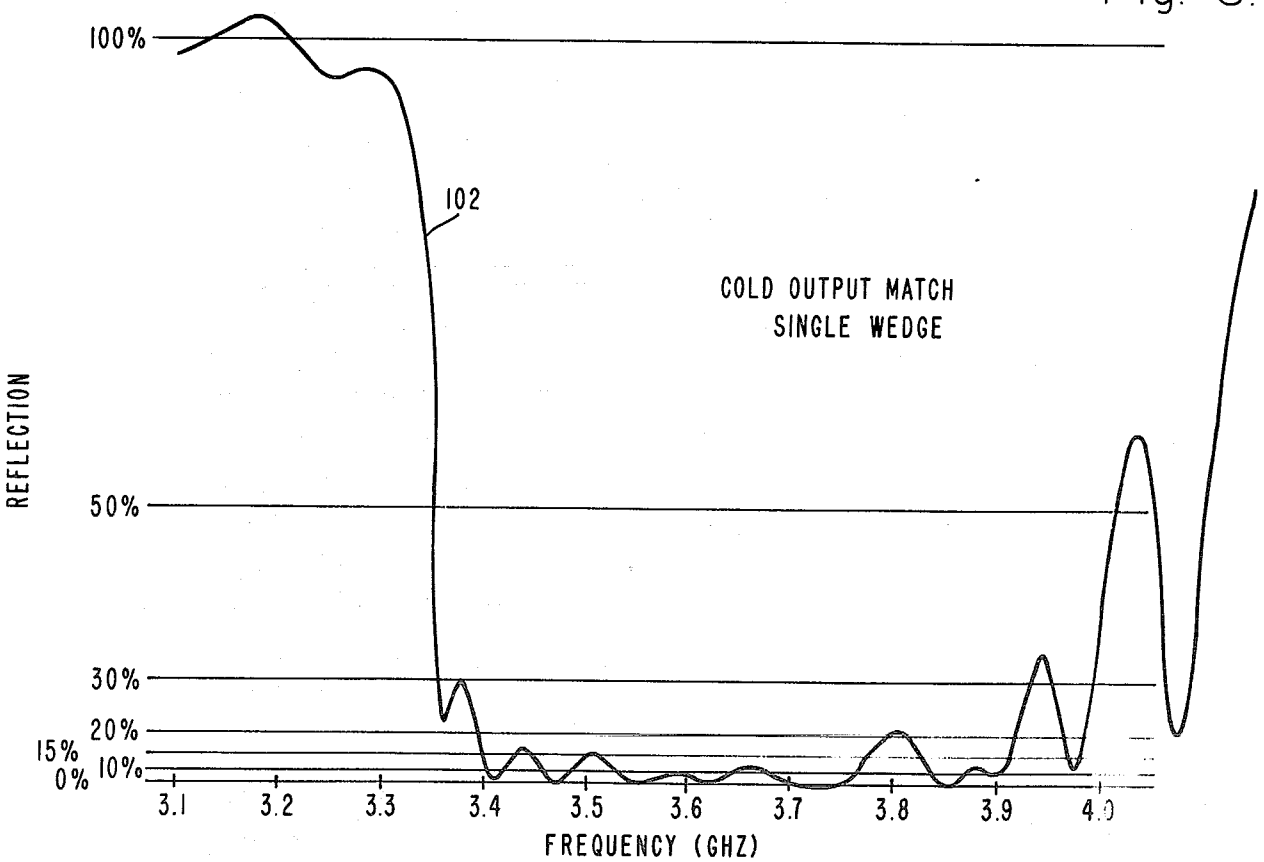
FIG. 8 is a graph of the output cold match test results for the single wedge termination device.

The output cold match test results on the double wedge termination ceramic 48', shown in FIG. 7 as curve 100, show little or no degradation from the output cold match test results for the single wedge termination ceramic 48 shown in FIG. 8 as curve 102. Conversely, little if any improvement is evident.

A similar cold match test was performed on the input section 18. The results of that test are shown as curve 104 in FIG. 9. The double wedge termination ceramic was in place in chamber 32 (of the two section TWT described above).

The cold match tests showed little if any change in cold match due to the double wedge ceramic 48'. It was thus not expected that the hot test would show any improvement in small signal gain variations.

Figure 9:
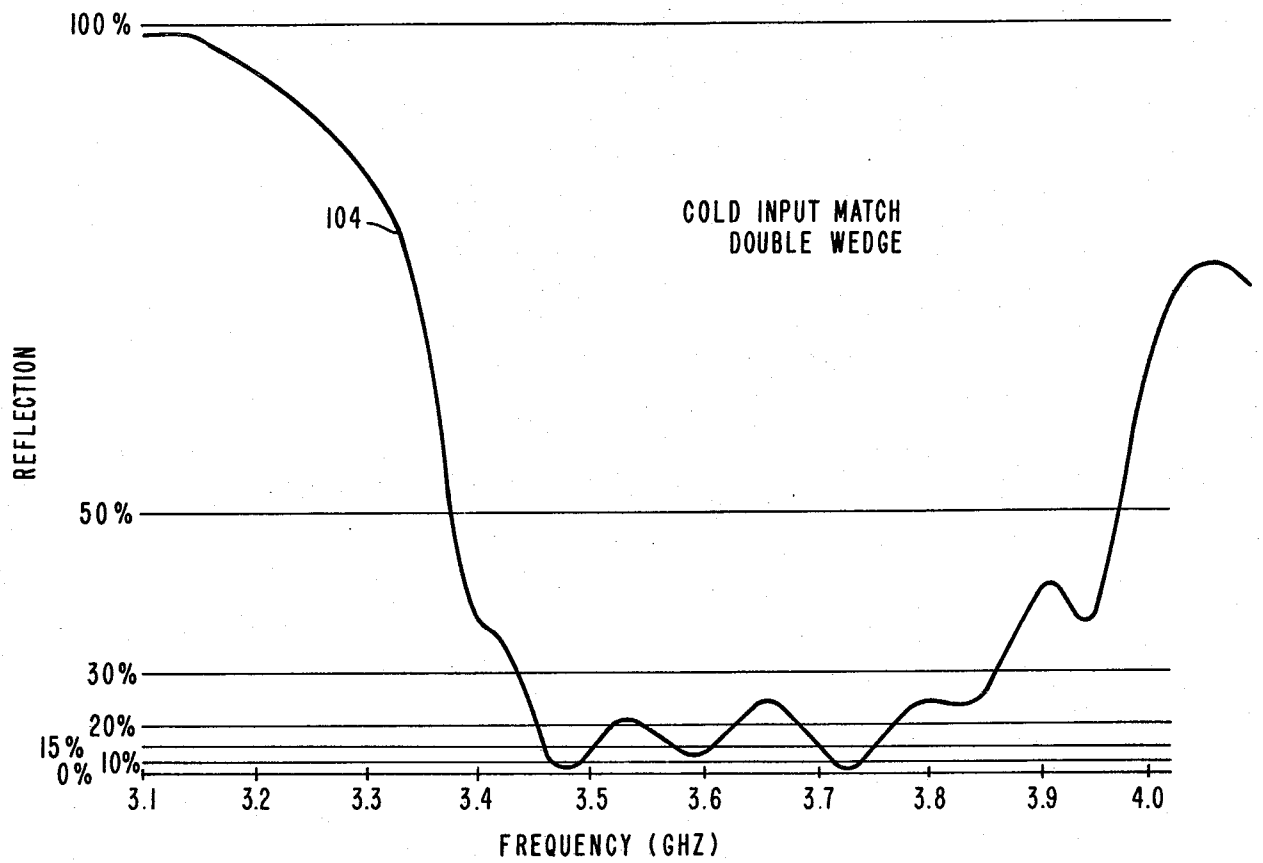
FIG. 9 is a graph of the input cold match test results for the double wedge termination device.

The test results shown in FIGS. 7, 8 and 9 were the results of tests run on a Hughes Aircraft Company model 595-H coupled cavity TWT with a frequency band of interest from 3.34 to 3.64 GHz. The percentage reflection is shown along the left hand vertical axis of the graph and frequency is shown along the horizontal axis.

Figure 10:
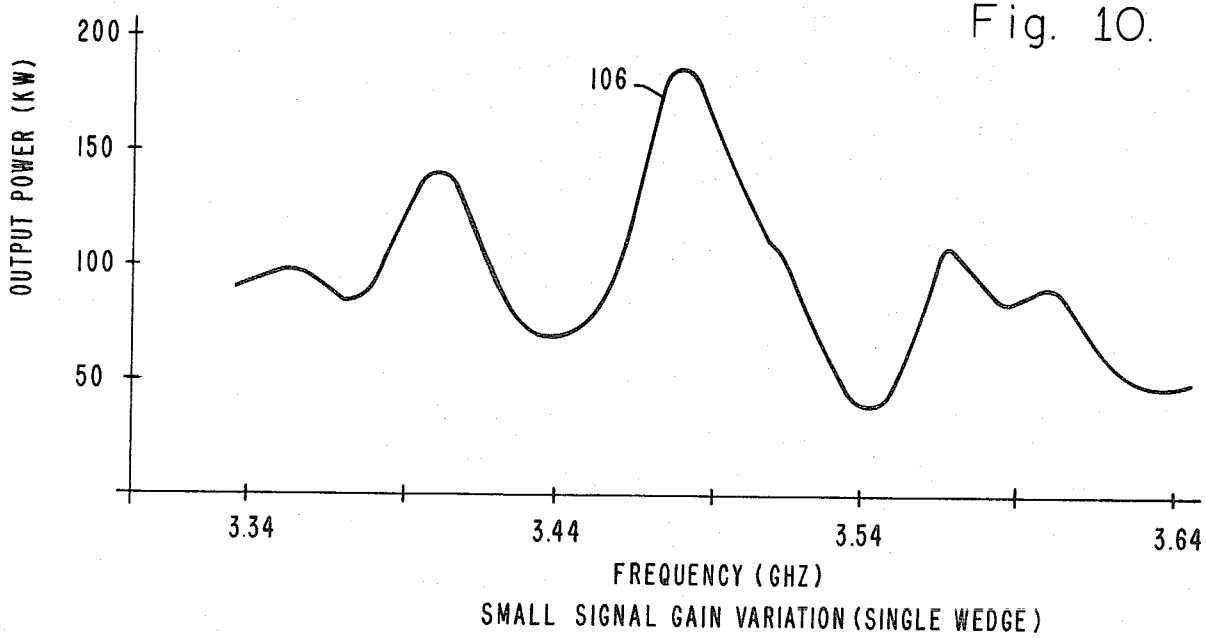
FIG. 10 is a graph of small signal gain variation using single wedge terminations on input and output.

Despite the fact that the cold match test results did not show any appreciable improvement in the cold match, (which would lead one to expect little or no improvement in the hot match test results) hot match tests were performed. For these tests normal operating voltages were used and the electron beam was turned on. An RF signal was supplied to the input RF coupler 12 and the output signal power level was measured at the RF output coupler 24. The "hot" test results for the single wedge termination ceramic 48 in both input and output termination chambers are plotted as curve 106 in FIG. 10. Curve 106 shows a small signal gain variation of about 6.72 dB. The highest level output power was 188 Kw and the lowest was 40 Kw. The small signal gain variation ($\Delta SSG$) is converted to a dB reading according to the formula:

$$\Delta SSG = 10 \log \frac{\text{highest power level}}{\text{lowest power level}}$$

For curve 106 this becomes 10 log 188/40=6.72 dB.

Figure 11:
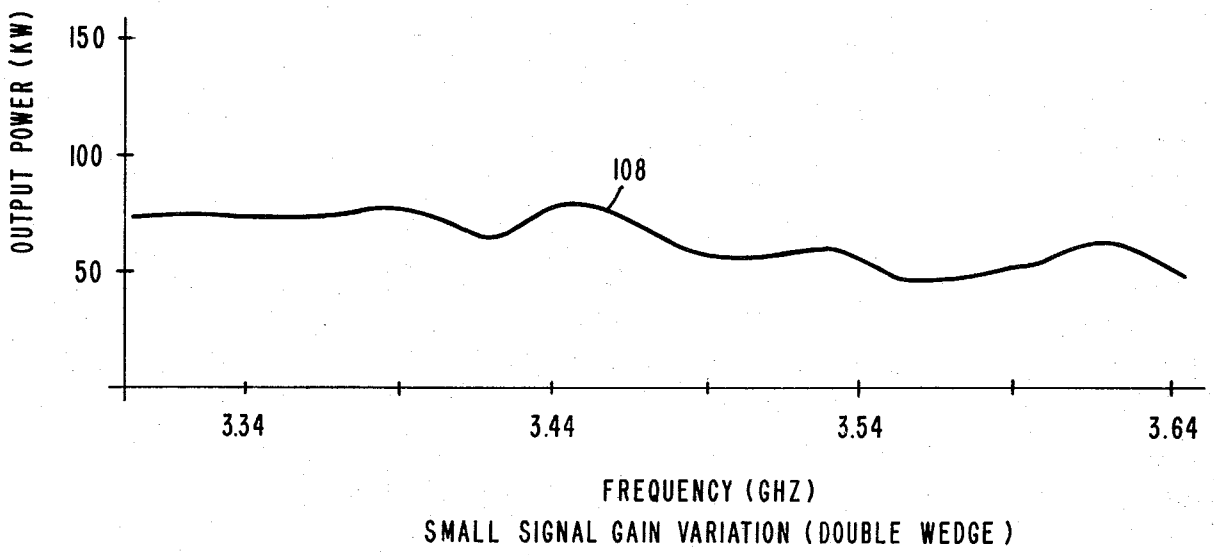
FIG. 11 is a graph of the improved small signal gain variation achieved by using double wedge terminations on input and output.

The corresponding hot test small signal gain variation for a double wedge termination ceramic 48' in both input and output chambers 32 and 38 is shown as curve 108 in FIG. 11.

In view of the lack of improvement in cold match test results, it was quite unexpected to find that the small signal gain variation for the hot test of the double wedge termination ceramic, in both chambers 32 and 38, had improved to 2.5 dB.

From FIG. 11: $\Delta SSG = 10 \log 80/45 = 2.5$ dB.

This improved small signal gain variation results in a TWT with greater frequency stability, more uniform gain compression across the frequency band, smaller phase ripple and less amplitude modulation to phase modulation conversion. Heat dissipation characteristics are also improved, which is an important consideration for high power TWTs.

These desirable results are achieved despite the increase in amount of ceramic introduced into the termination chamber and despite doubling the rate at which the incident RF waves encounter the ceramic material.

While the invention has been described herein with reference to FIGS. 1 through 11 and with reference to particular materials and dimensions, such references are for purposes of illustration only and should not be viewed as limitations upon the invention. It should be understood that many changes in structure and material may be made by one of ordinary skill in the art without departing from the spirit and scope of the invention as set forth in the appended claims.

What is claimed is:

1. In a coupled-cavity traveling-wave tube having a longitudinal axis and a plurality of termination chambers disposed therealong, each termination chamber being defined by first and second axially spaced radially extending walls and a circumferentially extending wall having an interior surface joining said first and second radially extending walls, a termination device disposed within each termination chamber for absorbing incident electromagnetic wave energy, said termination device comprising:

two substantially wedge-shaped portions of lossy material disposed in said termination chamber, each substantially wedge-shaped portion having a first surface sloped with respect to a second surface, the intersection of said first and second surfaces defining the edge of the substantially wedge-shaped portion;

said two substantially wedge-shaped portions being disposed with their respective second surfaces parallel and proximate to respective ones of said radially extending walls of said termination chamber and with their respective first surfaces in facing relationship and sloping toward one another;

the greatest separation between said first surfaces being at said edges, and said edges being disposed proximate and perpendicular to said longitudinal axis.

2. A termination device according to claim 1 wherein the respective first surfaces of said two substantially wedge-shaped portions intersect one another at a location slightly radially inwardly of said circumferentially extending wall.

3. A termination device according to claim 2 wherein said two substantially wedge-shaped portions contact one another over a radial distance between said circumferentially extending wall and the intersection of said respective first surfaces.

4. A termination device according to claim 1 wherein the slope between said first and second surfaces of each of said two substantially wedge-shaped portions is at an angle of approximately 24 degrees.

5. A termination device according to claim 1 and further comprising a pair of sidewall portions located laterally on opposite sides of said substantially wedge-shaped portions and extending axially from one substantially wedge-shaped portion to the other;

said sidewall portions having respective facing surfaces sloping toward one another to provide a minimum separation therebetween at the respective ends of said sidewall portions nearest to said circumferentially extending wall and a maximum separation between said facing surfaces at the opposite ends of said sidewall portions.

6. A termination device according to claim 5 wherein said sidewall portions extend beyond said edges of said substantially wedge-shaped portions at said opposite ends.

* * * * *